United States Patent [19]

Orr

[11] Patent Number: 4,877,211

[45] Date of Patent: Oct. 31, 1989

[54] RECREATIONAL VEHICLE LEVELING DEVICE

[76] Inventor: Paul I. Orr, 4039 Enero Way, San Diego, Calif. 92154

[21] Appl. No.: 313,061

[22] Filed: Feb. 21, 1989

[51] Int. Cl.[4] ..... B66F 7/00

[52] U.S. Cl. ..... 248/352; 254/94

[58] Field of Search ..... 248/676, 677, 678, 455, 248/456, 188.1, 188.2, 188.6, 188.9, 352; 254/88, 94

[56] References Cited

U.S. PATENT DOCUMENTS

| | | | |
|---|---|---|---|
| 1,405,567 | 2/1922 | Christensen | 254/94 |
| 1,624,243 | 4/1927 | Hoff | 254/88 |
| 1,738,205 | 12/1929 | Reidenbaugh | 254/88 |
| 1,947,346 | 2/1934 | Lintern | 254/94 |
| 1,996,612 | 4/1935 | Cook | 254/94 |
| 3,536,297 | 10/1970 | Garman | 254/94 |
| 3,661,229 | 5/1972 | Stonhaus | 188/32 |
| 3,684,233 | 8/1972 | Vukick | 254/94 |
| 3,784,161 | 1/1974 | Frese | 254/94 |
| 3,879,014 | 4/1975 | Larson | 254/94 |
| 4,013,268 | 3/1977 | Williams | 254/88 |
| 4,034,961 | 7/1977 | Breen | 254/94 |

FOREIGN PATENT DOCUMENTS

| | | | |
|---|---|---|---|
| 327344 | 10/1920 | Fed. Rep. of Germany | 254/88 |
| 628504 | 4/1936 | Fed. Rep. of Germany | 254/88 |
| 483707 | 5/1917 | France | 254/88 |
| 168814 | 9/1934 | Switzerland | 254/88 |
| 176161 | 3/1922 | United Kingdom | 254/88 |

*Primary Examiner*—Robert W. Gibson, Jr.
*Assistant Examiner*—Robert A. Olson
*Attorney, Agent, or Firm*—Charles C. Logan, II

[57] ABSTRACT

A recreational vehicle leveling device having a wheel receiving plate and a terrain engaging plate that are pivotally hinged to each other at their front ends. Both of these plates have a predetermined curvature along their longitudinal axis. The rear end of the wheel receiving plate has interlocking hinge structure with the top end of a rear spacer plate. The bottom end of the rear spacer plate is detachably received in a slot formed adjacent the rear end of the terrain engaging plate. In its collapsed state, the terrain engaging plate, the wheel receiving plate, and the rear spacer plate can be stacked upon each other to displace a minimum amount of space. Handle slots are formed adjacent the front end of the vehicle leveling device.

2 Claims, 1 Drawing Sheet

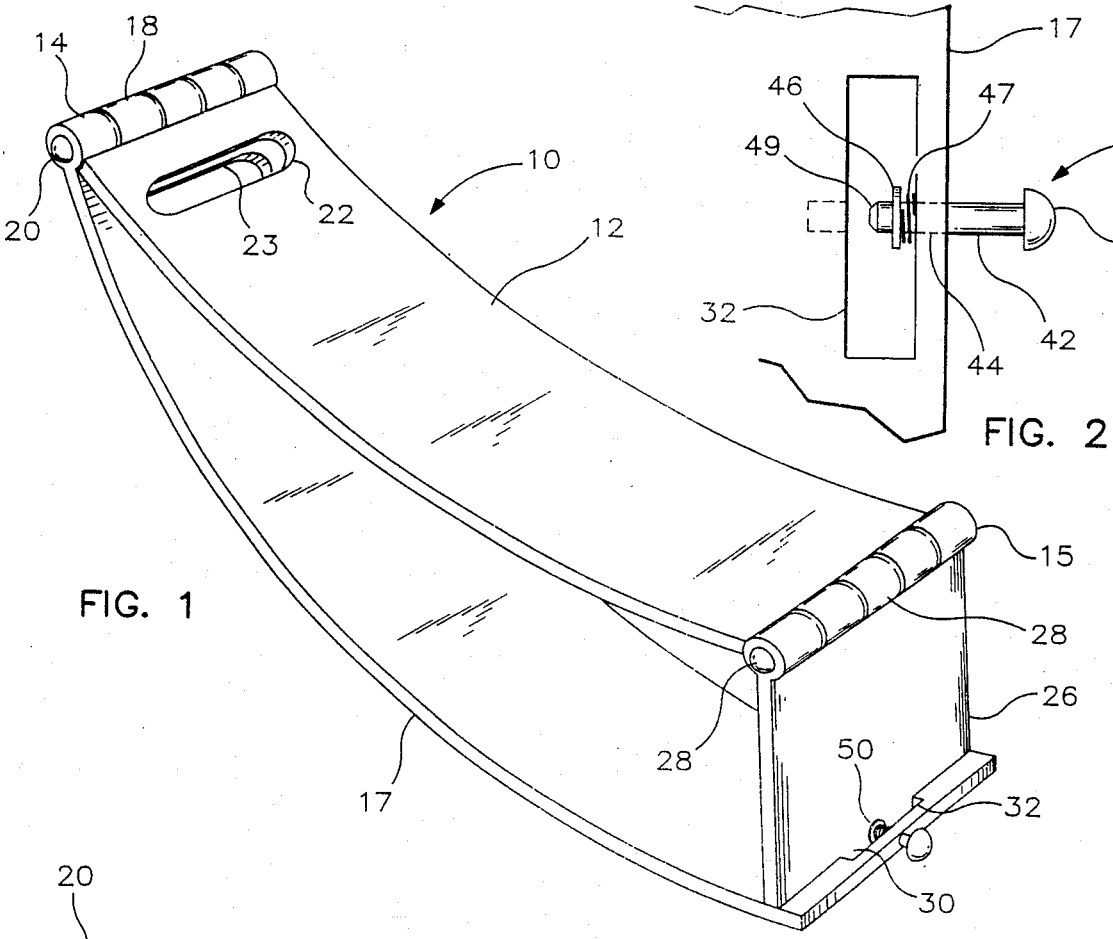
FIG. 1
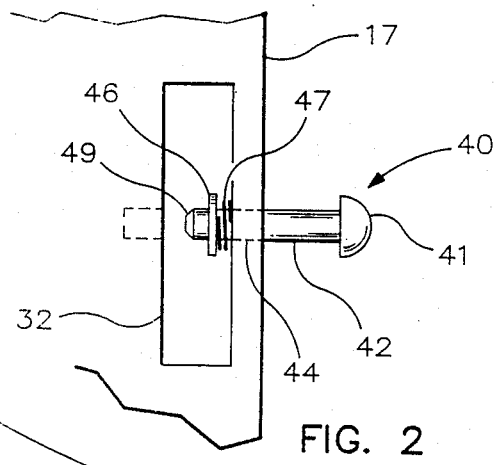
FIG. 2
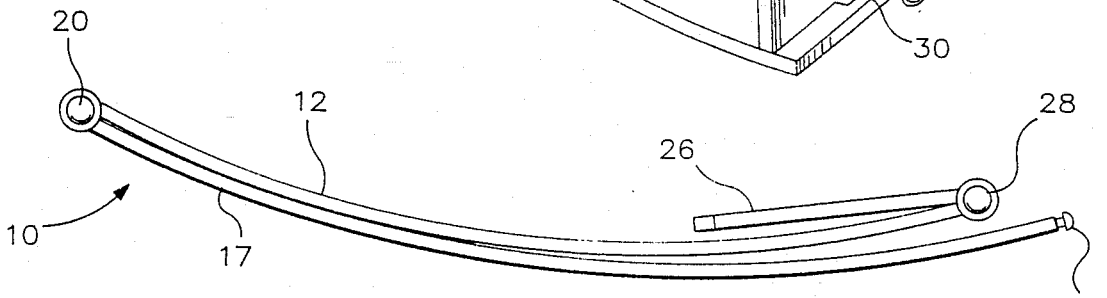
FIG. 3
FIG. 4
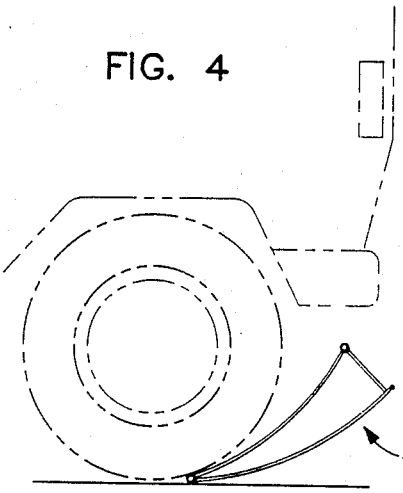
FIG. 5
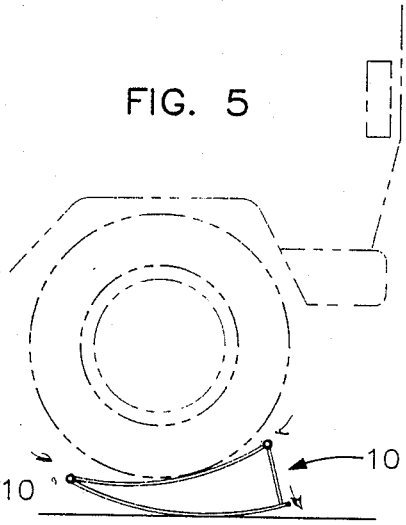
FIG. 6
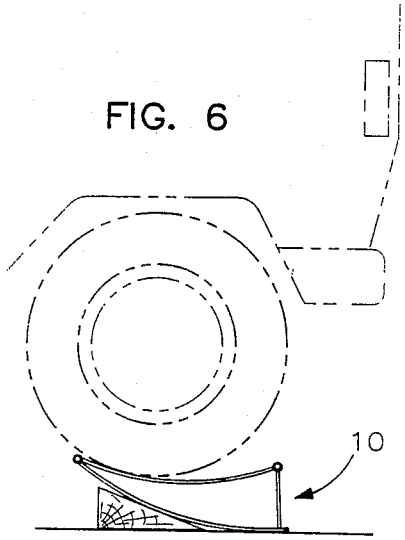

RECREATIONAL VEHICLE LEVELING DEVICE

BACKGROUND OF THE INVENTION

The present invention relates to a vehicle leveling device and, more particularly, to a simple and efficent device for use with mobile homes, trailers, campers, and the like to permit the leveling thereof regardless the local terrain.

Camping is a recreational activity enjoyed by millions of people. Camping vehicles, in order to be enjoyed, should be placed as near to level or horizontal as possible. Unfortunately, campgrounds are not normally level parking areas. Campers will usually therefore bring with them blocks of wood, bricks or other items to be used and constructed into a makeshift incline. Makeshift inclines have problems of adequacy. They can be too narrow for the tire, they may be too short to obtain a level condition. They may not be substantial enough to maintain support and the vehicle will come abruptly off the incline when people move about within the camper. Applicant's device solves the problem of adequate leveling of a camper vehicle. Its design gives it substantial strength.

A leveling device is simple to use and very fast to install in place. Leveling of the vehicle is therefore accomplished by simply placing the leveling device of the instant invention under the low side wheel and driving on to the wheel receiving plate. When the vehicle reaches a level position, the driver stops and inserts a small block or chock under the front end of the leveling device.

There is, therefore a need for a device which is highly transportable and simple to use with high reliability. In addition to all this, the device is collapsible so that it requires a minimum of storage space.

SUMMARY OF THE INVENTION

Applicant's novel recreational vehicle leveling device has been designed to provide structure for leveling a vehicle such as a camper, on an unlevel surface. It has an elongated wheel receiving plate having a predetermined curvature along its longitudinal axis. Its front end is pivotally secured to an elongated terrain engaging plate having a predetermined curvature along its longitudinal axis. A rear spacer plate is pivotally secured to the rear end of the wheel receiving plate and its bottom end is detachably received in a slot adjacent the rear end of the terrain engaging plate.

To use the device, the front edge is placed under a wheel and the wheel is rotated forwardly thereon. As the wheel advances, the curved surfaces of the wheel receiving plate and terrain engaging plate produce a lifting action for the wheel that increases proportionately with the distance traveled thereon. When the wheel is lifted to a point where the vehicle is level or horizontal, forward motion of the wheel is stopped. The parked vehicle camper will therefore be more comfortable for recreational purposes.

When not in use, the vehicle leveling device can be collapsed into a compact state. The rear wall plate has its bottom end detached from the slot in the terrain engaging plate and it is pivoted upwardly and overly so that it rests on the top surface of the wheel receiving plate. The wheel receiving plate in turn collapses downwardly on to the top surface of the terrain engaging plate. Aligned handle slots adjacent the front end of the respective wheel receiving plate and terrain engaging plate provide a convenient structure for carrying the vehicle leveling device. The width of the vehicle leveling device is such that it can accomodate common pick-up truck and camper tire width. When not being used to adjust the leveling of a truck or camper, the device can be utilized as a wheel chock.

DESCRIPTION OF THE DRAWINGS

FIG. 1 is a front perspective view illustrating applicant's novel recreational vehicle leveling device in its set up state;

FIG. 2 is a partial view illustrating the structure adjacent the rear end of the terrain engaging plate that is utilized to detachably secure the bottom end of the rear spacer plate;

FIG. 3 is a side elevation view illustrating the vehicle leveling device folded up into its compact state;

FIG. 4 is a side elevation view illustrating the vehicle leveling device as it is initially inserted under the wheel of the vehicle;

FIG. 5 is a side elevation view illustrating the wheel as it has traveled a predetermined distance along the top of the leveling device; and FIG. 6 is a side elevation view illustrating the leveling device showing the wheel advanced to its forward most position.

DESCRIPTION OF THE PREFERRED EMBODIMENT

Applicant's novel recreational vehicle leveling device will now be described by referring to FIGS. 1-6 of the drawings. The vehicle leveling device is generally designated numeral 10.

Vehicle leveling device 10 has a wheel receiving plate 12 having curved hinge fingers 14 formed on its front end and curved hinge fingers 15 formed on its rear end. Terrain engaging plate 17 has curved hinge fingers 18 formed on its front end that interlock with curved hinge fingers 14 and are secured in position by a hinge pin 20. Aligned handle slots 22 and 23 are formed in the respective wheel receiving plate and terrain engaging plate adjacent their forward ends.

A rear spacer wall 26 has curved hinge fingers 28 formed on its top end and they interlock with curved hinge fingers 15 and are securely held in position by hinge pin 28. A tongue 30 extends from the bottom edge of rear spacer plate 26 and it is received in a slot 32 formed adjacent the rear end of terrain engaging plate 17. The structure for detachably securing these two members together is best illustrated in FIG. 2. A pin 40 having a head 41 and a shank 42 is inserted into a bore 44 formed in terrain engaging plate 17. A shoulder 46 is provided on shank 42 to capture one end of a spring 47. The tip 49 of pin 40 passes through an aperature 50 in tongue 30. To disengage the bottom edge of rear spacer plate 26, it is merely necessary to pull on the head of pin 40 which will allow the tip 49 to be removed from aperature 50. Upon releasing the tension on pin 40, spring 47 will cause it to travel rearwardly.

The plates of the vehicle leveling device could be fabricated of high-impact plastic or other strong lightweight material.

The drawings as shown and thusly described represent the preferred embodiment of the invention. It would be obvious to one skilled in the art that various changes and modifications, simple or complex, could be made to the preferred embodiment which would alter the appearance but not the scope, spirit and intention of the invention. It is the intention of the inventor to preclude the occurrence of such emulations in design, scope or spirit through the following claims.

What is claimed is:

1. A recreational vehicle leveling device comprising:

an elongated wheel receiving plate having a predetermined curvature along its longitudinal axis, said wheel receiving plate having a front end and a rear end, a plurality of laterally spaced curved hinge fingers formed on said front end, a plurality of laterally spaced curved hinge fingers formed on said rear end;

an elongated terrain engaging plate having a predetermined curvature along its longitudinal axis, said terrain engaging plate having a front end and a rear end, a plurality of laterally spaced curved hinge fingers formed on said front end;

means for connecting the respective hinge fingers on the front ends of said wheel receiving plate and said terrain engaging plate to form a first hinge assembly;

a rear spacer plate having a top end and a bottom end, a plurality of laterally spaced curved hinge fingers formed on said top end, a tongue member extends downwardly from the bottom end of said rear spacer plate and it has an aperture therein;

means for connecting the respective hinge fingers on the rear end of said wheel receiving plate and on the top end of said rear spacer plate to form a second hinge assembly; and means for detachably securing the bottom end of rear spacer plate to the rear end of said terrain engaging plate comprising; a transversely extending slot formed in said elongated terrain engaging plate adjacent its rear end, a bore hole is also formed in the end of said elongated terrain engaging plate and said bore hole communicates with said slot, a pin having a head and a shank is inserted into said bore hole, a coil spring is slipped over the shank of said pin and a shoulder member is attached to said shank to capture one end of said spring, said pin having a tip that passes through the aperture in the tongue of said spacer plate to form a rigid leveling device structure, to disengage the bottom end of said spacer plate it is merely necessary to pull the head of said pin which will allow the tip to be removed from the bore hole in said tongue and the respective members of said leveling device can be folded into a compact stack.

2. A recreational vehicle leveling device as recited in claim 1 further comprising aligned handle slots adjacent the front ends of said wheel receiving plate and said terrain engaging plate to provide convenient structure for carrying said vehicle leveling device.

* * * * *